United States Patent [19]

Rivkin

[11] Patent Number: 5,054,126

[45] Date of Patent: Oct. 8, 1991

[54] REVERSIBLE PROTECTIVE GLOVE

[75] Inventor: Richard A. Rivkin, Deerfield, Ill.

[73] Assignee: Saf-T-Gard International, Inc., Northbrook, Ill.

[21] Appl. No.: 586,417

[22] Filed: Sep. 21, 1990

[51] Int. Cl.[5] ..... A41D 19/00; A41D 13/10

[52] U.S. Cl. ..... 2/161 R; 2/162; 2/DIG. 2

[58] Field of Search ..... 2/162, 158, 159, DIG. 2, 2/160, 161 R, 161 A, 163, 164, 169, 16; 24/904, 686

[56] References Cited

U.S. PATENT DOCUMENTS

| | | | |
|---|---|---|---|
| 1,371,841 | 3/1921 | Berkwits | 2/DIG. 2 |
| 1,385,715 | 7/1921 | Ross | 2/162 |
| 1,498,489 | 6/1924 | Steinmetz | 2/DIG. 2 X |
| 2,791,779 | 5/1957 | Presson | 2/DIG. 2 X |
| 2,831,196 | 4/1958 | Scheiber | 2/161 A |
| 3,296,628 | 1/1967 | Collins | 2/DIG. 2 X |
| 4,004,295 | 1/1977 | Byrnes, Sr. | 2/161 R |
| 4,388,733 | 6/1983 | Anstett | 2/161 R |
| 4,471,495 | 9/1984 | Kruse et al. | 2/162 |
| 4,750,218 | 6/1988 | Ziegler | 2/159 |
| 4,841,577 | 6/1989 | Lars-Jos | 2/161 R |
| 4,843,650 | 7/1989 | Kangas et al. | 2/159 |

OTHER PUBLICATIONS

"Armor-Touch" Advertisement, Jan. 1988.

*Primary Examiner*—Werner H. Schroeder
*Assistant Examiner*—Sara M. Current
*Attorney, Agent, or Firm*—Silverman, Cass & Singer, Ltd.

[57] ABSTRACT

A reversible protective glove formed of wire mesh material of the type intended to be worn by meat cutters, the glove having a wrist strap attached to the cuff thereof. The strap has a free end with a removable fastening member having a protrusion positioned thereon and facing in a first direction. A pair of oppositely facing grommets is positioned on the strap proximate an end thereof opposite the free end and which is attahced to the cuff. The protrusion of the removable fastening member is adapted for receipt in a selected one of the grommets to firmly secure the strap about a user's wrist when the glove is positioned on the user's right hand. The glove may be reversed by turning the same inside out and the removable fastening member relocated on the free end of the strap with the protrusion facing in a direction opposite the first direction to be received in the other grommet to firmly secure the strap when the glove is positioned on a user's left hand.

4 Claims, 1 Drawing Sheet

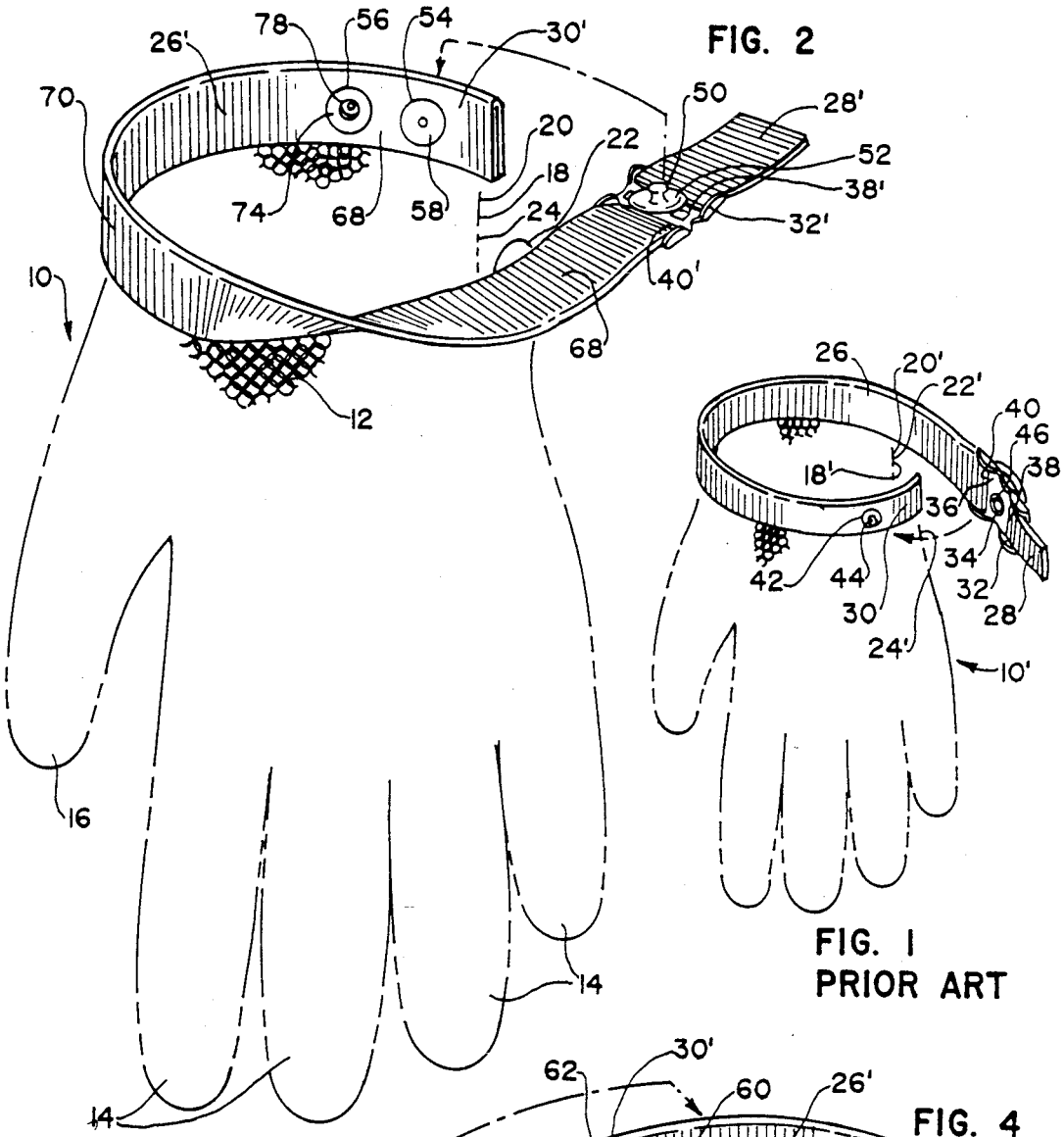
FIG. 1
PRIOR ART
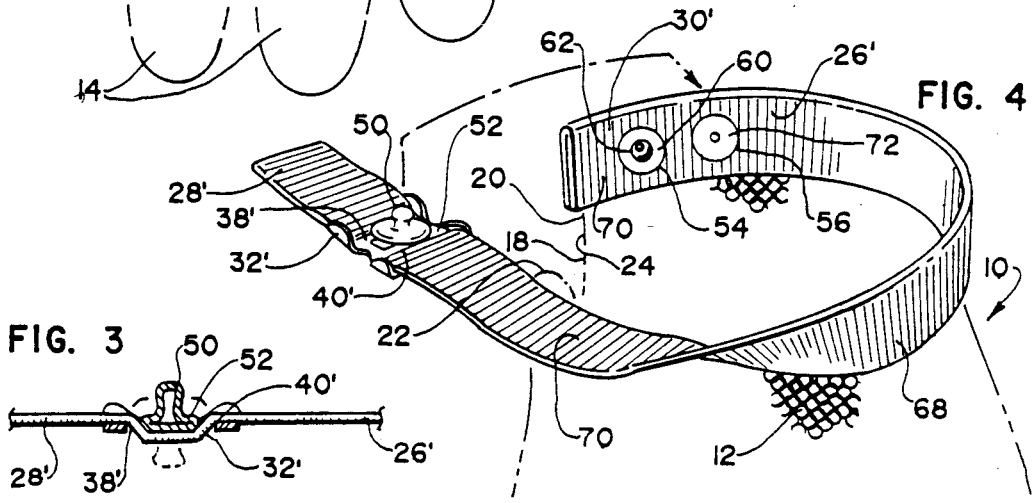

REVERSIBLE PROTECTIVE GLOVE

BACKGROUND OF THE INVENTION

1. Field of the Invention

This invention relates generally to protective gloves, and more particularly, to a protective glove formed of wire mesh material of the type intended to be worn by meat cutters, the glove being reversible for interchangeable use on a user's right or left hand.

2. Description of the Prior Art

Protective gloves formed of wire mesh material or mail are known for use by meat cutters. Such gloves prevent inadvertent injury to a user's hand during the meat cutting operation. Normally, it is necessary for a meat cutter to wear a protective glove on one hand only because the other hand is used to hold the knife and therefore is not likely to be injured during the cutting operation. Most prior art protective gloves are not reversible and therefore, it has been required to provide both left- and right-hand gloves for use by either left- or right-handed persons. Since gloves of the type involved are generally expensive to manufacture, this has been a significant disadvantage in the prior art.

There are instances of reversible protective gloves which are known in the art, but they are of fairly complex construction which renders them difficult to use and expensive to fabricate.

It therefore is desirable to provide a reversible protective glove which is of relatively non-complex construction and which may readily be secured to either the left or right hand of a user as selectively desired.

SUMMARY OF THE INVENTION

The invention provides a reversible metal mesh glove with a fabric band or straps secured about the cuff thereof. Two grommets are affixed to the band proximate one end thereof, one grommet facing a first surface of the band, and the other facing the opposite surface of the band. A fastening member with a protrusion formed thereon is removably positioned on a free end of the band opposite said one end, with the protrusion facing in a first direction. The protrusion is adapted for receipt in a selected one of the grommets to firmly secure the band about a user's wrist when the glove is positioned on the user's right hand. The glove is reversible by turning the same inside out and relocating the removable fastening member on the free end of the band with the protrusion facing in a direction opposite the first direction to be received in the other grommet to firmly secure the band when the glove is positioned on a user's left hand.

Various objects and advantages of the invention will become apparent in accordance with the foregoing disclosure in which a preferred embodiment is described in detail in the specification and illustrated in the accompanying drawing. It is contemplated that minor variations may occur to the skilled artisan without departing from the scope or sacrificing any of the advantages of the invention.

BRIEF DESCRIPTION OF THE DRAWING

FIG. 1 is a perspective view of a prior art nonreversible protective glove showing one type of wrist band fastener;

FIG. 2 is a perspective view showing the protective glove of the invention;

FIG. 3 is a sectional view taken through the removable fastening member positioned on the band of the glove shown in FIG. 2, with an alternate position of the fastening member illustrated in phantom outline; and FIG. 4 is a fragmentary perspective view of said glove showing the wrist band portion thereof after the glove has been reversed from its disposition illustrated in FIG. 2.

DESCRIPTION OF THE PREFERRED EMBODIMENT

The drawing illustrates a protective glove 10 formed of conventional wire mesh material or mail 12 and having four fingers 14 and thumb part 16. A V-slot 18 is provided in the wire mesh proximate the smallest finger part 14 and opening to the wrist portion 20 of the glove 10. The V-slot 18 provides a wide opening proximate the wrist portion 20 to permit insertion of a user's hand (not shown) into the glove. The V-slot is closed by drawing together the terminal edges 22, 24 thereof when the wrist portion 20 is secured about the user's wrist when the glove is secured thereon.

FIG. 1 illustrates a prior art non-reversible glove 10' in which a wrist band or strap 26 is secured to the wrist portion 20' of the glove 10' in conventional manner, such as by stitching. The glove 10' could be formed either as a right or left-hand glove, but once so formed is not usable as a reversible glove. The wrist strap 26 has a free end 28 which extends beyond the terminal edge 22' of V-slot 18', and a fixed end 30 opposite the end 28, the end 30 terminating at the terminal edge 24' of V-slot 18'. Free end 28 of wrist strap 26 is provided with a movable fastening member 32 having a grommet 34 positioned on one side 36 thereof. The free end 28 of strap 26 passes through respective slots 38, 40 in fastening member 32 to permit the member to be moved along the length of said free end 28 to a selected location thereon where the fastening member is retained by functional engagement with the strap.

The fixed end 30 of strap 26 of the prior art FIG. 1 glove is provided with a snap-fastener 42 having a protrusion 44 facing outwardly of the glove. Upon positioning the glove 10' on the intended right or left hand of the user, the free end 28 of strap 26 is moved around the user's wrist so that the grommet hole 46 formed in grommet 34 engages protrusion 44 to secure the glove on the user's hand.

The glove 10 of the invention is shown in FIGS. 2–4. The mesh material 12 is of construction substantially the same as that of glove 10', except glove 10 is reversible by turning the same inside out to function either as a right or left-hand glove. Wrist strap 26' is secured to the wrist portion 20 of glove 10 in the same conventional manner, such as by stitching. There is a free end 28' which extends beyond the terminal edge 22 of V-slot 18, and a fixed end 30' opposite the end 28', the end 30' terminating at the terminal edge 24 of V-slot 18.

Removable fastening member 32' is positioned on free end 28' of strap 26'. Fastening member 32' is similar in constructural details to fastening member 32, except in one very important respect. Fastening member 32' has a protrusion 50 formed on one side 52 thereof, rather than a grommet as is the case with fastening member 32. Free end 28' of strap 26' passes through slots 38', 40' in fastening member 32' in the same manner as with the prior art member to permit the member to be moved along the length of the free end 28' to a selected location on the strap where the member 32′ is retained by frictional engagement with the strap.

The fixed end 30′ of strap 26′ of glove 10 is provided with a pair of grommets 54, 56. Grommet 54 has a back side 58 secured through strap 26′ on one surface 68 thereof to engage and retain thereon front side 60 of the grommet which presents grommet hole 62 to the opposite surface 70 of the strap 26′. Likewise grommet 56 has a back side 72, but back side 72 is positioned on surface 70 of strap 26′ and passes therethrough to engage and retain thereon front side 74 of the grommet which presents grommet hole 78 to the surface 68 of strap 26′. Accordingly, one grommet has a grommet hole facing on one surface of strap 26′, and the other grommet has a grommet hole facing on the opposite surface of the strap so that there is one grommet hole opening to an outwardly facing surface of glove 10′ irrespective of whether it is oriented as a left-hand glove, or reversed to function as a right-hand glove.

In use, the glove 10 is positioned on a selected hand of the user. As shown in FIG. 2, the free end 28′ of strap 26′ is moved around the user's wrist so that the protrusion 50 on fastening member 32′ faces surface 68 of strap 26′ and engages within grommet hole 62 of grommet 54. If it is desired to use the glove 10 on the opposite hand of a user, the glove is reversed by turning the same inside out so that it is oriented as shown in FIG. 4. Fastening member 32′ is slid off the free end 28′ of strap 26′ and re-positioned thereon with the protrusion facing surface 70 of strap 26′ in the direction on strap 26′ which is opposite to the first positioned direction, as shown in FIG. 3. The free end 28′ then is moved around the user's wrist so that protrusion 50 engages within grommet hole 78 of grommet 56.

The importance of the grommets being positioned on the fixed end 30′ of strap 26′ rather than a snap-fastener 42 having protrusion 44 resides in the fact that the fixed end 30′ is closely spaced from or in contact with a user's wrist when the glove is worn on the user's hand. The orientation of snap-fastener 42 on fixed end 30′ would render the reversible glove 10 of the invention unsatisfactory in operation because protrusion 44 of one of the fasteners would uncomfortably engage into the user's wrist. Utilization of the grommets 54, 56 proximate the fixed end 30′ prevents this problem because no protrusion is present on these parts, but rather only is presented on the fastening member 32′ which does not engage against a user's wrist in either the FIG. 2 or FIG. 4 orientation of the glove.

While the foregoing invention has been described with reference to its preferred embodiment, various alterations and modifications may occur to those skilled in the art. All such alterations and modifications are intended to fall within the scope of the appended claims.

I claim:

1. In a reversible glove having finger portions formed of metal mesh material with a fabric band secured to a cuff thereof, the glove having a generally V-shaped slit formed proximate the smallest finger portion thereof and opening to the cuff, said band having a free end extending beyond one edge of the V-shaped slit and a fixed end opposite the free end and terminating proximate the other edge of the V-shaped slit, the improvement comprising, a fastening member movably positioned on said free end the fastening member including a protrusion formed on one side thereof and facing a first surface of the band, a first grommet and a second grommet affixed to the band proximate to the fixed end, said grommets being spaced apart relative to each other, the first grommet having a first grommet hole facing said first surface of the band and the second grommet having a second grommet hole facing the opposite surface of the band, said grommet holes being adapted for selected and removable receipt therein of the protrusion formed on the fastening member, whereby the band may be wrapped about the wrist of one of a user's hands with the protrusion of the fastening member engaged in the first grommet hole to firmly secure the band on the user's wrist.

2. The invention as claimed in claim 1 in which the glove may be reversed by turning the same inside out, said fastening member being removable from the free end and relocated thereon such that the protrusion faces the opposite surface of the band and is engaged within the second grommet hole when the glove is positioned on the user's other hand.

3. A reversible glove having finger portions formed of metal mesh material with a fabric band secured to a cuff thereof, said glove comprising, a generally V-shaped slit formed proximate the smallest finger portion thereof and opening to the cuff, said band having a free end extending beyond one edge of the V-shaped slit and a fixed end opposite the free end and terminating proximate the other edge of the V-shaped slit, a fastening member movably positioned on said free end, the fastening member including a protrusion formed on one side thereof and facing a first surface of the band, a first grommet and a second grommet affixed to the band proximate to the fixed end, said grommets being spaced apart relative to each other, the first grommet having a first grommet hole facing said first surface of the band and the second grommet having a second grommet hole facing the opposite surface of the band, said grommet holes being adapted for selected and removable receipt therein of the protrusion formed on the fastening member, whereby the band may be wrapped about the wrist of one of a user's hands with the protrusion of the fastening member engaged in the first grommet hole to firmly secure the band on the user's wrist.

4. A glove as claimed in claim 3 in which the glove may be reversed by turning the same inside out, said fastening member being removable from the free end and relocated thereon such that the protrusion faces the opposite surface of the band and is engaged within the second grommet hole when the glove is positioned on the user's other hand.

* * * * *

UNITED STATES PATENT AND TRADEMARK OFFICE

CERTIFICATE OF CORRECTION

PATENT NO. : 5,054,126

DATED : October 8, 1991

INVENTOR(S) : Richard A. Rivkin

It is certified that error appears in the above-identified patent and that said Letters Patent is hereby corrected as shown below:

On the Title page

Abstract, line 9, correct spelling of "attached";

Column 4, line 6, insert a comma (,) after "end".

Signed and Sealed this

Twenty-third Day of February, 1993

*Attest:*

STEPHEN G. KUNIN

*Attesting Officer*

*Acting Commissioner of Patents and Trademarks*